US005369869A

United States Patent [19]

Bies et al.

[11] Patent Number: 5,369,869

[45] Date of Patent: Dec. 6, 1994

[54] METHOD FOR MAKING AN INSULATED DOOR WITH SYNTHETIC RESIN SKINS

[75] Inventors: Sylvester W. Bies; Robert A. Juran, both of Lake Orion, Mich.; Aldo Romanelli, Pompano Beach, Fla.

[73] Assignee: The Stanley Works, New Britain, Conn.

[21] Appl. No.: 75,858

[22] Filed: Jun. 11, 1993

Related U.S. Application Data

[62] Division of Ser. No. 751,324, Aug. 28, 1991, Pat. No. 5,239,799.

[51] Int. Cl.[5] ..... B22D 17/00

[52] U.S. Cl. ..... 29/460; 29/527.1; 29/530; 156/79; 264/46.5

[58] Field of Search ..... 29/455.1, 460, 463, 29/527.1, 530, 559, DIG. 29; 264/46.5; 156/79; 49/501

[56] References Cited

U.S. PATENT DOCUMENTS

| | | | |
|---|---|---|---|
| 3,455,078 | 7/1969 | Brown et al. | 52/802 |
| 3,786,609 | 1/1974 | Difazio | 52/802 |
| 3,950,894 | 4/1976 | Di Maio | 49/501 |
| 4,019,302 | 4/1977 | Meyer . | |
| 4,144,690 | 3/1979 | Avery . | |
| 4,152,878 | 5/1979 | Balinski . | |
| 4,236,365 | 12/1980 | Wheeler . | |
| 4,550,540 | 11/1985 | Thorn . | |
| 4,743,485 | 5/1988 | Ting . | |
| 4,838,000 | 6/1989 | Ljungkvist . | |
| 4,850,168 | 7/1989 | Thorn . | |
| 4,860,512 | 8/1989 | Thorn . | |
| 4,864,789 | 9/1989 | Thorn . | |
| 4,901,493 | 2/1990 | Thorn . | |
| 5,021,108 | 6/1991 | Bergqvist | 264/46.5 |

*Primary Examiner*—Mark Rosenbaum
*Assistant Examiner*—David P. Bryant

[57] ABSTRACT

A door has a pair of spaced stiles at its side edges, a top rail extending between the upper ends of the rails, and a pair of synthetic resin skins providing the faces of the door and adhesively bonded to the stiles and rail. The skins have opposed flanges along their top and bottom edges which abut to form top and bottom peripheral walls, and they also have opposing spaced lips along the side edges thereof which extend along a portion of the outer surfaces of the stiles. The peripheral walls provided by the flanges have vent openings extending therethrough, and a cellular synthetic resin core is bonded to the skins and fills the interior space between the skins bounded by the stiles, rail and bottom flange. Baffled passages are provided between the vent openings and the interior space. In making She door, after the skins have been assembled and adhered to the stiles and rails, the stiles and flanges effectively seal the interior space which they define and this assembly is placed in a heated press. As a foamable resin mixture is injected under pressure into the interior space and expands therein, air is expelled through the baffled passages and vent openings, and the press precludes bowing outwardly of the skins.

10 Claims, 8 Drawing Sheets

FIG. 4
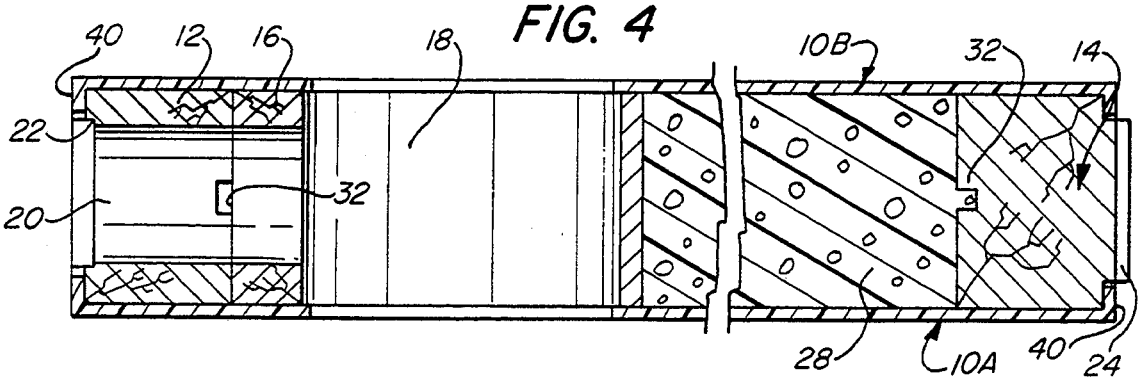
FIG. 5
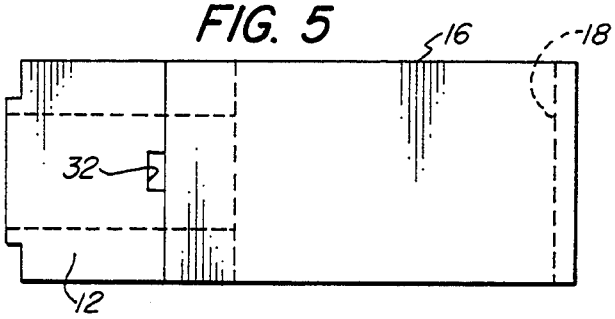
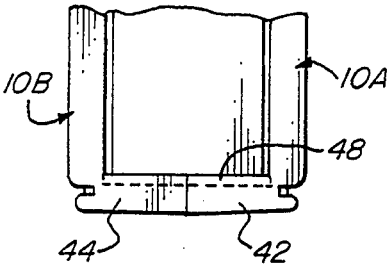
FIG. 6
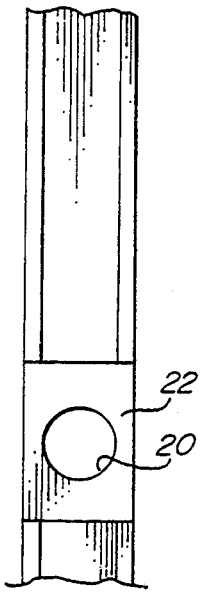
FIG. 7
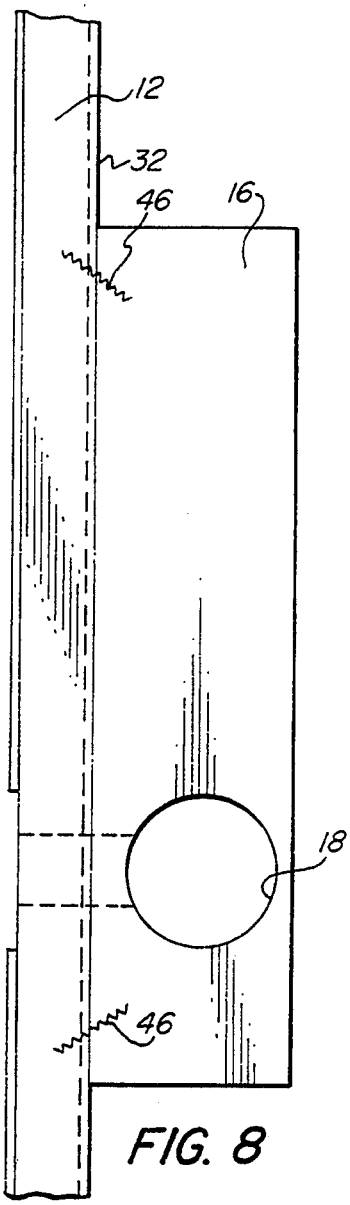
FIG. 8

METHOD FOR MAKING AN INSULATED DOOR WITH SYNTHETIC RESIN SKINS

This is a divisional of application Ser. No. 07/751,324 filed on Aug. 28, 1991, now U.S. Pat. No. 5,239,79 .

BACKGROUND OF THE INVENTION

The present invention relates to doors with synthetic resin skins and synthetic resin cores, and to methods for making such doors.

For many years, exterior doors were fabricated from solid wood slabs in order to provide strength and good weathering characteristics as well as an attractive appearance. Many of these doors were sculpted to provide panels, and other doors interfitted panels into apertures formed within the basic door structure. Because of the cost of such solid slab doors, and the need to find wood slabs which were relatively free from imperfections to provide a good surface for such doors, many companies made doors which employed veneers adhered to a core of less expensive wood. Unfortunately, such veneers have had a tendency to delaminate and/or to split over years of exposure in an exterior environment, particularly one which provides substantial thermal cycling and direct exposure to rain and sun.

In addition to the economic pressures, a number of communities have adopted building codes requiring that doors utilized in certain locations have fire resistant, or at least fire retardant properties. This led to the development of doors with metal skins secured to a wooden or metal skeleton to provide the desired strength for the structure. Various materials including foamed synthetic resin have been used as the core material in these doors to provide insulation between the metallic faces to reduce heat and sound transfer therebetween. Unfortunately, such metal skin doors cannot be stained to simulate wood, and they are generally readily identifiable as metal skins rather than wood which is in aesthetic disadvantage. Moreover, the metal skins are readily dented.

Two decades ago Owens-Corning Fiberglass introduced into the marketplace doors which employed compression molded skins formed from fiberglass reinforced polyester. These skins were molded with panels to simulate conventional wooden doors and also employed an expanded synthetic resin between the skins to fill the space therebetween. The fiberglass skins could be stained to appear wood-like and they could also be molded with embossed patterns. Since that time, a number of companies have manufactured doors employing such molded fiberglass skins. Many of these doors have utilized a rectangular wooden frame of stiles and rails to provide the structural strength for the assembly.

It is an object of the present invention to provide a novel method for making a door employing molded synthetic resin skins which may be practiced easily and economically.

It is also an object to provide such a method for making a door which substantially resists warping and which also will successfully resist the bending forces when the door is closed with substantial force.

Another object is to provide such a method for making a door which is attractive and exhibits long life, and which may be easily assembled in a door frame.

SUMMARY OF THE INVENTION

It has now been found that the foregoing and related objects may be readily attained in a door having major faces, latch and hinge side edges, and top and bottom edges. The door has a pair of spaced stiles at the side edges of the door and a top rail extending between the side rails adjacent the top edge of the door. A pair of synthetic resin skins providing the faces of the door are adhesively bonded to the stiles and rail, and opposing flanges along their top and bottom edges abut to form peripheral walls extending along the top and bottom edges of the door. The skins also have opposed spaced lips along the side edges thereof which extend along a portion of the outer surfaces of the stiles. The peripheral walls provided by the flanges have vent openings extending therethrough.

A cellular synthetic resin core fills the interior space between the skins and bounded by the stiles, rail and bottom flange, and it is bonded to the skins. Baffled passage means provide restricted passages communicating between the vent openings and the interior space.

In the preferred embodiment, the skins are molded from fiber reinforced synthetic resin, and the flanges have opposing portions configured to interfit.

The lower portions of the skins have horizontally extending channels in the faces thereof, and the final door installation includes a bottom sealing member having upstanding arms providing a U-shaped recess in which the bottom of the door is seated and horizontally extending fingers which seat in the channels.

In some embodiments, there is included a metallic stiffening member for the stile providing the latch side of the door. The stiffening member may be of channel shaped cross section and receive the stile in its channel, or it may be of I-shaped cross section and portions of the stile interfit therewith. A latch block may also be provided between the skins inwardly of the latch stile to provide a reinforced area for seating a lock set.

Preferably, the skins have horizontally extending stops adjacent the bottom flanges thereof providing abutments against which the lower portions of the stiles abut to effect positioning thereof. The skins may also have additional horizontally extending stops spaced upwardly from and in alignment with those adjacent the bottom flange to limit bowing of the stiles.

The baffled passage means includes baffle elements formed on the bottom flanges about the vent openings and providing a passage communicating between the vent openings and the interior space through a restricted passage. The baffled passage means also include aligned channels in the stiles and rail extending along the inside surface of the stiles and the upper surface of the rail and communicating between the interior space and the vent openings in the top peripheral wall.

In the method of making the door, synthetic resin is molded to form the skins providing the faces of the door. The pair of spaced stiles is placed at the side edges of a skin and the top rail is placed so that it extends between the .stiles adjacent the top edge of the skin. The stiles and rail are adhesively bonded to this skin and then the second skin is placed on, and it is adhesively bonded to, the stiles and rail. The assembly of skins, stiles and rail is supported in a heated press, and a foamable synthetic resin mixture is introduced under pressure into the interior space between the stiles, rail and flanges. The resin mixture forces air from the interior space to exit through the baffled passages and vent openings, and the mixture expands and forms a cellular synthetic resin core filling the interior space. The core bonds to the skins, and the press prevents the skins from being bowed outwardly under the pressure of the expanding synthetic resin mixture.

Desirably, the foamable synthetic resin mixture forms a cellular polyurethane, and the synthetic resin used to form the skins is a fiber reinforced polyester.

BRIEF DESCRIPTION OF THE DRAWINGS

FIG. 4 is a fragmentary cross sectional view drawn to an enlarged scale along the line 4–4 of FIG. 1;

FIG. 5 is a top plan view of the latch stile/lock block assembly of FIG. 3;

FIG. 6 is a fragmentary side edge elevational view of the bottom of the door;

FIG. 7 is a fragmentary end elevational view of the latch stile of the door;

FIG. 8 is a fragmentary side elevational view of the latch stile/lock block assembly drawn to an enlarged scale;

DETAILED DESCRIPTION OF THE PREFERRED EMBODIMENT

Figure 1:
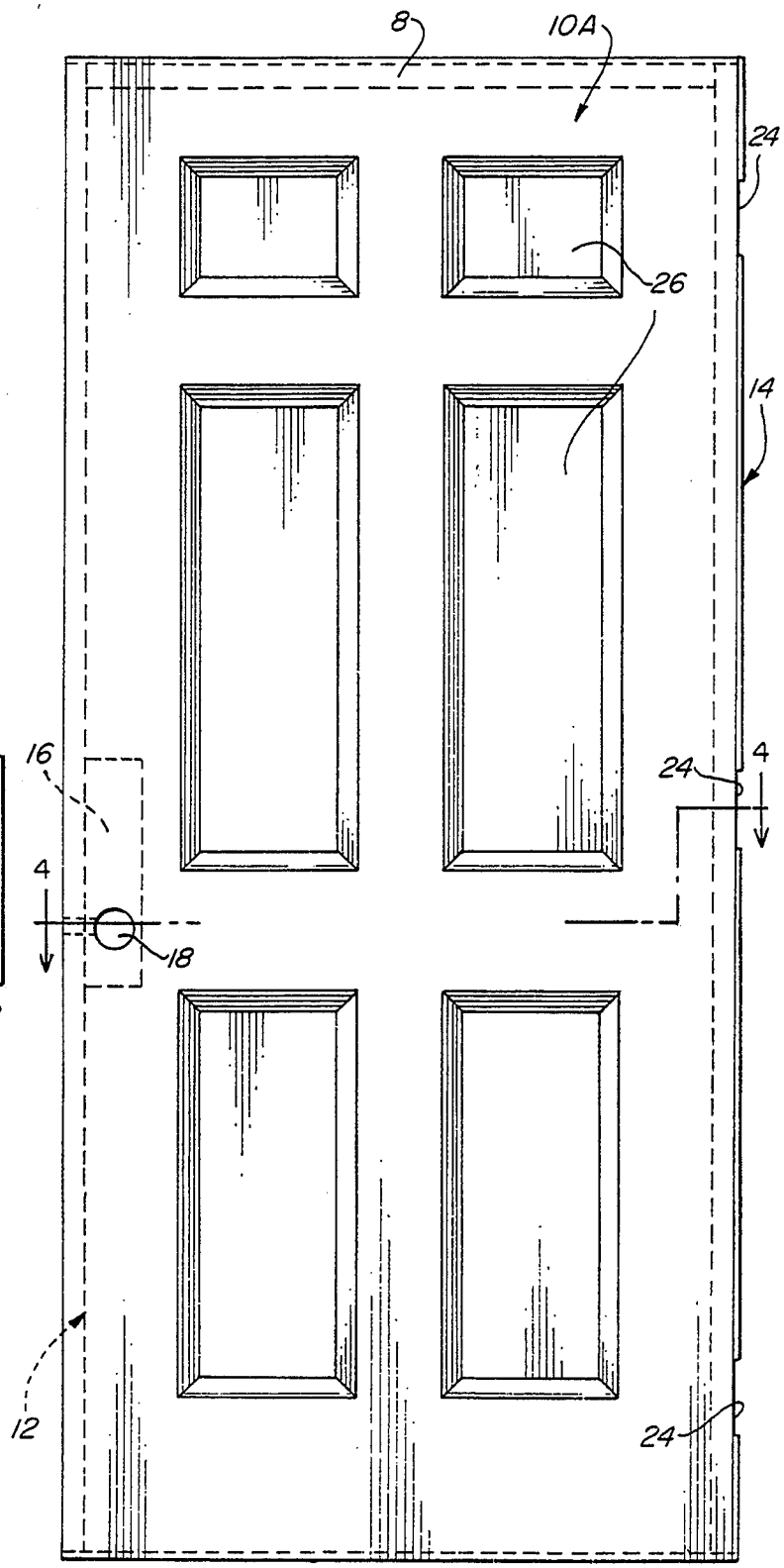
FIG. 1 is a front elevational view of a door embodying the present invention.

Turning first to FIG. 1, therein illustrated is a door embodying the present invention which has a pair of molded synthetic resin skins 10 which have embossed portions providing simulated panels 26 and which are adhered to the latch stile 12, the hinge stile 14 and the top rail 8, all of which are indicated in dotted line. The skins 10A, 10B are identical as molded so that the same skins may be used for both faces. Also seen in dotted line is a lock block 16 which is secured to the latch stile 12, and a through hole 18 for seating the latch set (not shown) extends through the skins 10 and lock block 16.

Figure 2:
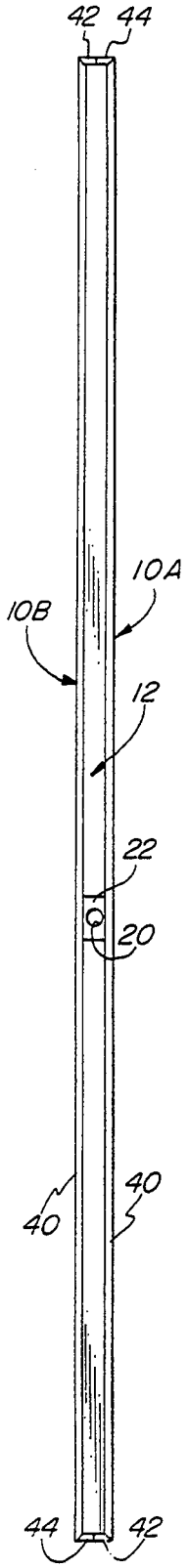
FIG. 2 is a side elevational view of the latch edge of the door.

In FIG. 2 it can best be seen that the skins 10 have lips 40 along the side edges thereof which extend in opposed relationship over a portion of the width of the stiles 12, 14, and that there are abutting flanges 42, 44 along the top and bottom edges. Essentially, the skins 10A, 10B are symmetrical about their vertical center line as molded except for the flanges 42, 44 which have one configuration for their interfitting portions along one half and cooperating configurations for the other half. Also seen in FIGS. 2 and 3 are the mortised area 22 for the face plate of the lock set (not shown), and the latch bolt passage 20.

Figure 3:
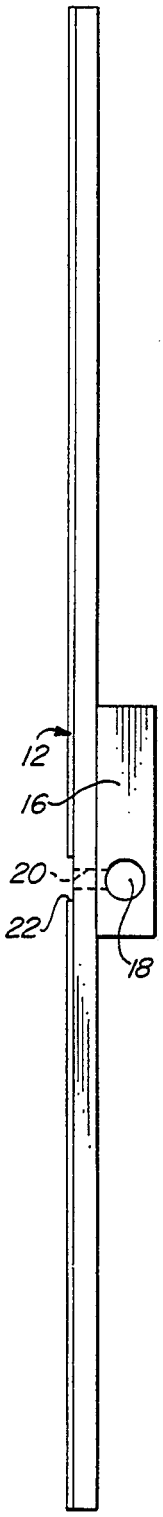
FIG. 3 is a side elevational view of the latch stile showing the lock block appended thereto.

In FIG. 3, the assembly of the lock block 16 to the wood stile 12 is more clearly illustrated and the opening 18 for seating the lock set is also shown quite clearly. Returning to FIG. 1, it can be seen that the hinge stile 14 has a series of mortised areas 24 for seating the hinges (not shown).

Turning next to FIGS. 7 and 8, it can be seen that the lock block 16 is secured to the latch stile 12 by staples 46. The dotted line illustration along the right hand side of the latch stile 12 as seen in FIG. 8 represents a vertical groove or passage 32 in the center of the inside face of the stile 12, and this passage 32 can also be seen in FIGS. 4 and 5. The hinge stile 14 has a similar passage 32.

As best seen in FIG. 4, the lips 40 on the skins 10 seat in recesses formed in the outer face of the stiles 12 and 14. A cellular synthetic resin core 28 fills the space between the stiles 12, 14, rail 8 and the flanges 42, In FIG. 6 it can be seen that the flanges 42, 44 at the top and bottom of the skins 10 have relatively shallow end lips 48 extending horizontally.

Figure 9:
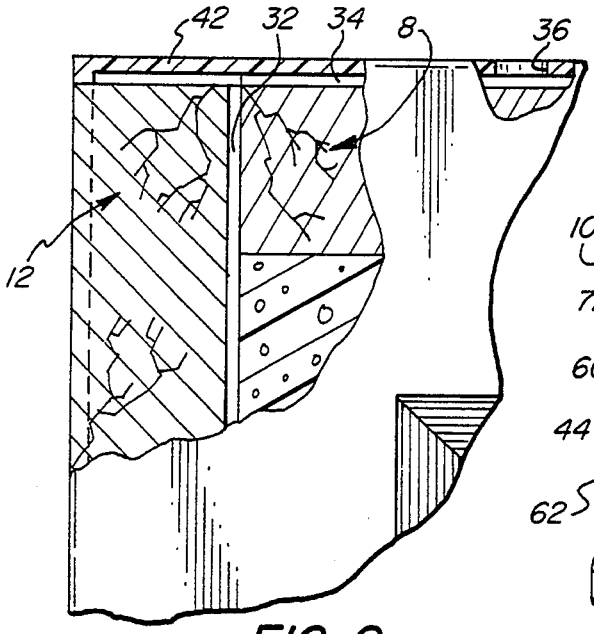
FIG. 9 is a fragmentary front elevational view of the upper edge portion of the door with portions broken away to reveal internal/construction.

Turning next to FIG. 9, it can be seen that the stiles 12, 14 have grooves or passages 32 in the center of their inside faces, and these extend along the full length thereof. The top rail 8 has a groove or passage 34 in the center of its top face, and its ends are aligned with the passages 32 in the stiles 12, 14. Air from the interior space is vented through the baffled passage provided by these passages 32, 34 and exits through the exit ports 36 formed in the abutting faces of the flanges 42.

Figure 10:
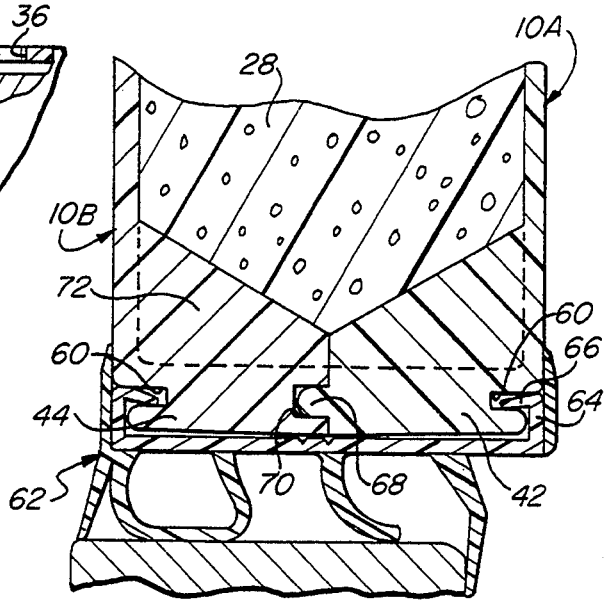
FIG. 10 is a cross sectional view of the bottom of the door showing a bottom seal or sweep mounted thereon.

Turning next to FIG. 10, it can be seen that the outer faces of the flanges 42, 44 at the bottom edge of the skin 10A, 10B are formed with channels 60 extending horizontally thereacross. A bottom sweep or sealing member generally designated by the numeral 62 has a U-shaped upper portion 64, and inwardly extending fingers 66 at the upper end thereof seat in the channels 60. This sweep construction is the subject matter of copending application Ser. No. 07/642,421 filed Jan. 17, 1991 by Sylvester Bies entitled SELF-POSITIONING AND SELF-LOCKING DOOR SWEEP AND DOOR ASSEMBLY THEREWITH, which is assigned to Applicants' assignee.

As also seen in FIG. 10, the flanges 42, 44 are formed at various points along their length with a projecting tongue 68 and a recess 70 at other points along their length to receive the tongue 68. Thus, when two skins are assembled, the tongue 68 on one flange 42, 44 will fit into the recess or channel 70 on the other flange 42, 44.

Moreover, as seen in FIG. 10, at spaced points along their length corresponding to their areas of the tongues 68 and grooves 70, the skins 10A, 10B have reinforcing ribs 72 along their bottom ends which are angled to the abutting edges of the flanges 42, 44. These strengthen and rigidify the bottom of the assembled door.

Figure 12:
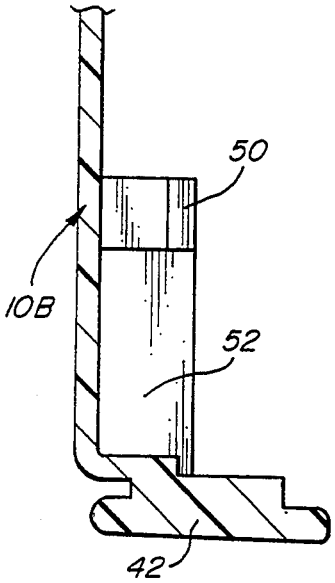
FIG. 12 is a cross sectional view along the lines 12—12 of FIG. 11.
Figure 11:
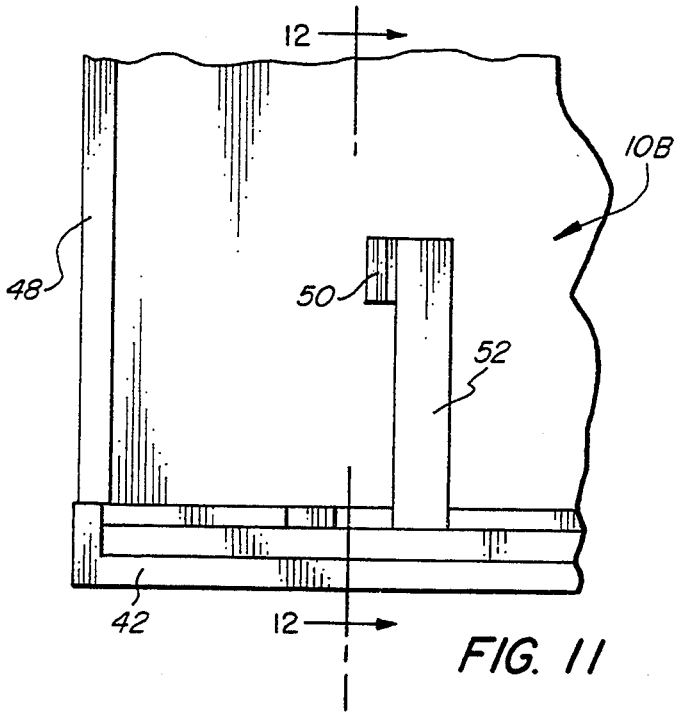
FIG. 11 is a fragmentary view of the bottom portion of a door skins showing the bottom stop on positioning element found therein.

Turning now to FIGS. 11 and 12, the bottom of the skins 10 have horizontally extending bosses 50 against which the lower end of the stiles 12, 14 abut to effect their positioning. The horizontal boss 50 has a vertical formation 52 behind it in order to ensure that sufficient resin and fiber flows into the boss 50 and to enhance the structural strength of the bore 50.

Figure 13:
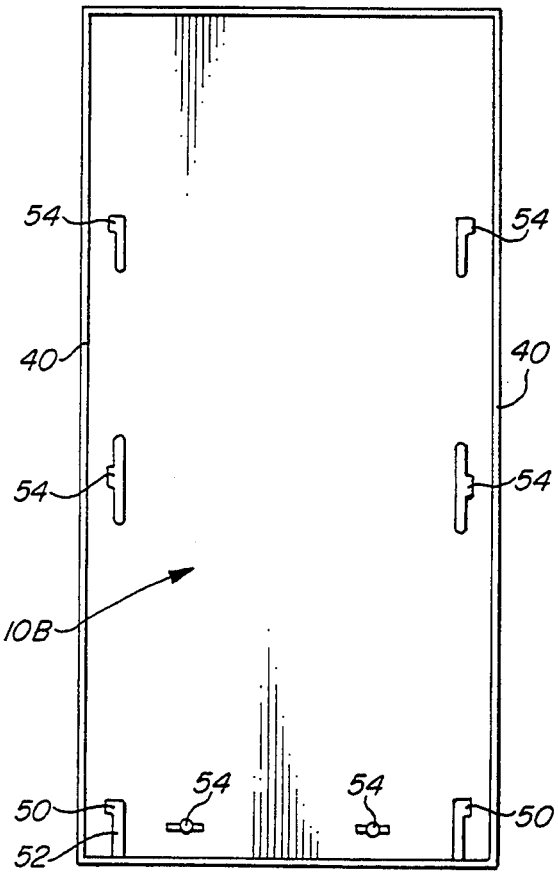
FIG. 13 is an elevational view of the interior surface of a door skin of FIG. 1 showing the several stops or positioning elements for the stiles.

As seen in FIG. 13, several additional bosses 54 are vertically spaced thereabove and aligned therewith to again provide abutments for the stiles 12, 14 and prevent their bowing inwardly or warping. Thus, the stiles are trapped between the lips 40 and the bosses 50, 54.

Figure 14:
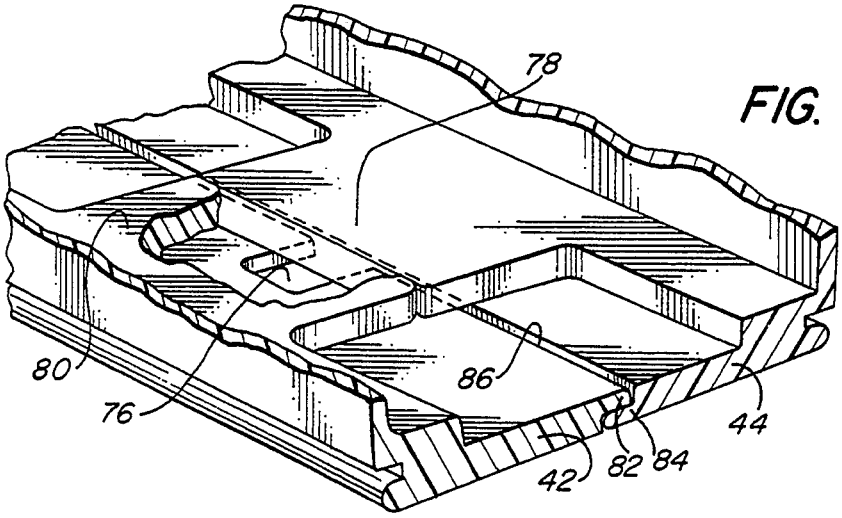
FIG. 14 is an enlarged fragmentary perspective view of the baffle assembly at the bottom portion of the door skins with a portion broken away to reveal internal construction.
Figure 15:
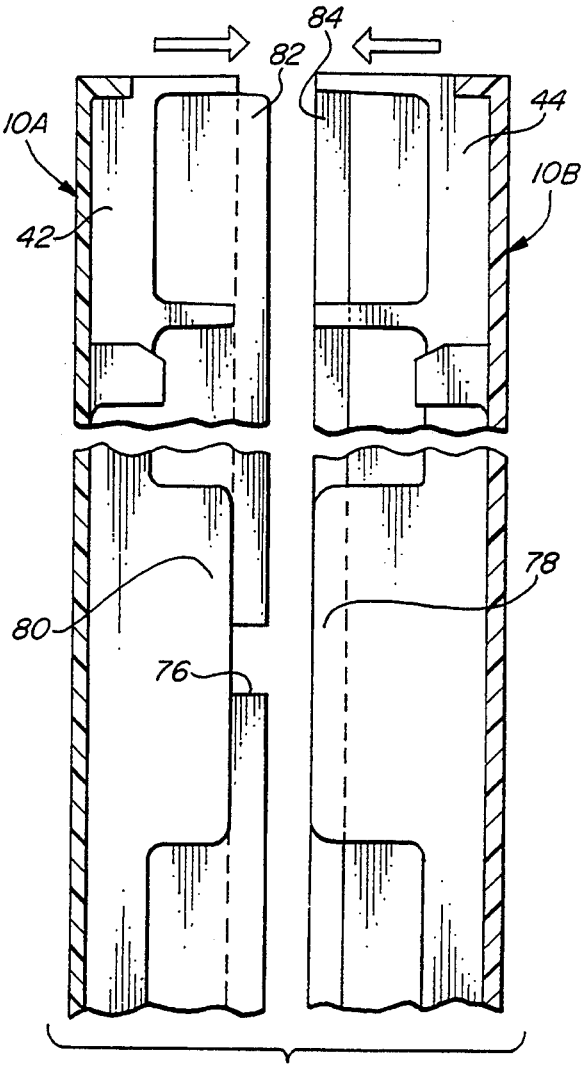
FIG. 15 is a cross sectional view of the disassembled skins interfitting flanges showing the configuration of the flanges and their baffle components.
Figure 16:
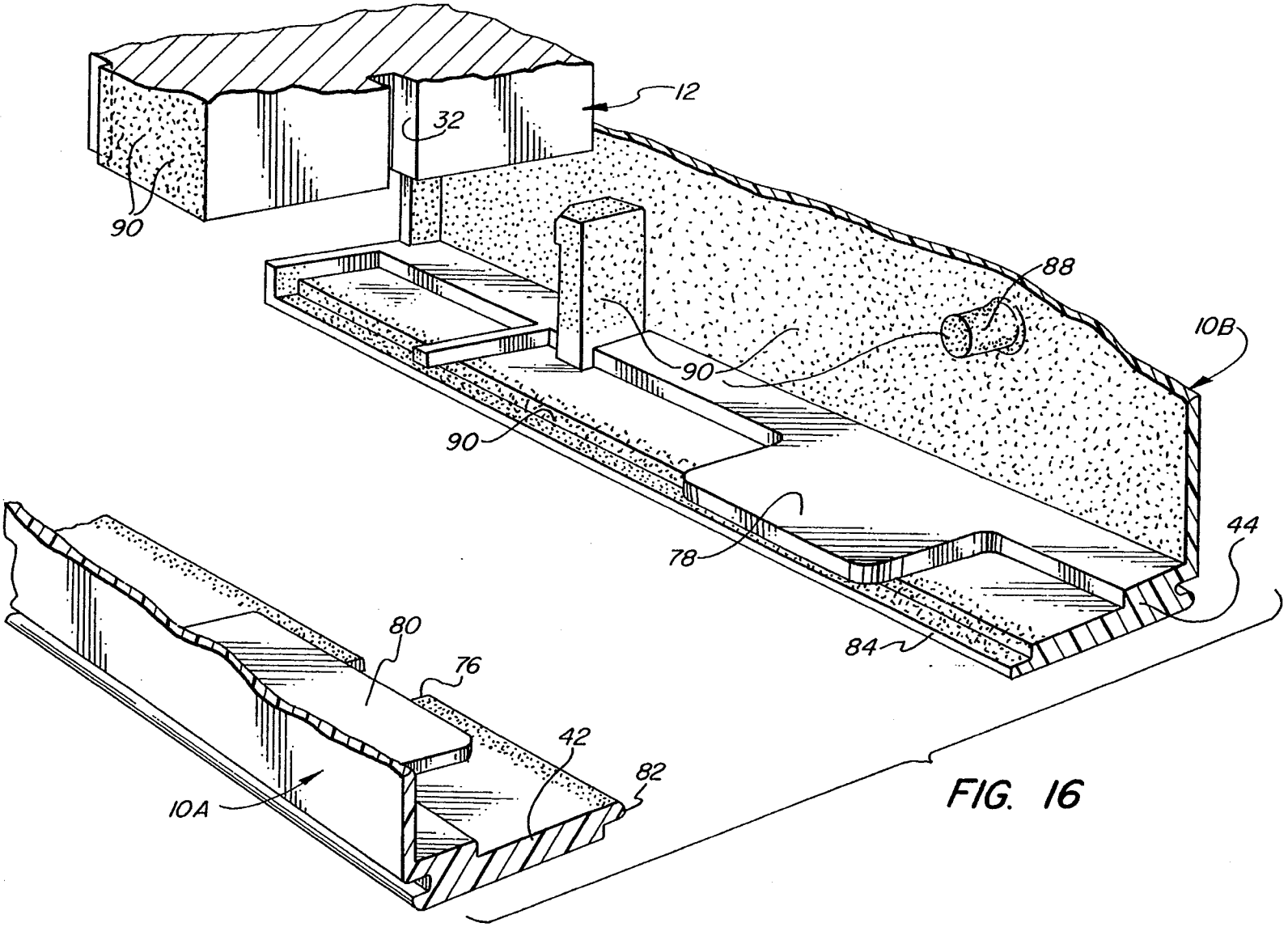
FIG. 16 is a fragmentary perspective view of the latch end of the skins and stile adjacent the bottom of the door with the elements exploded.
Figures 17, 18:
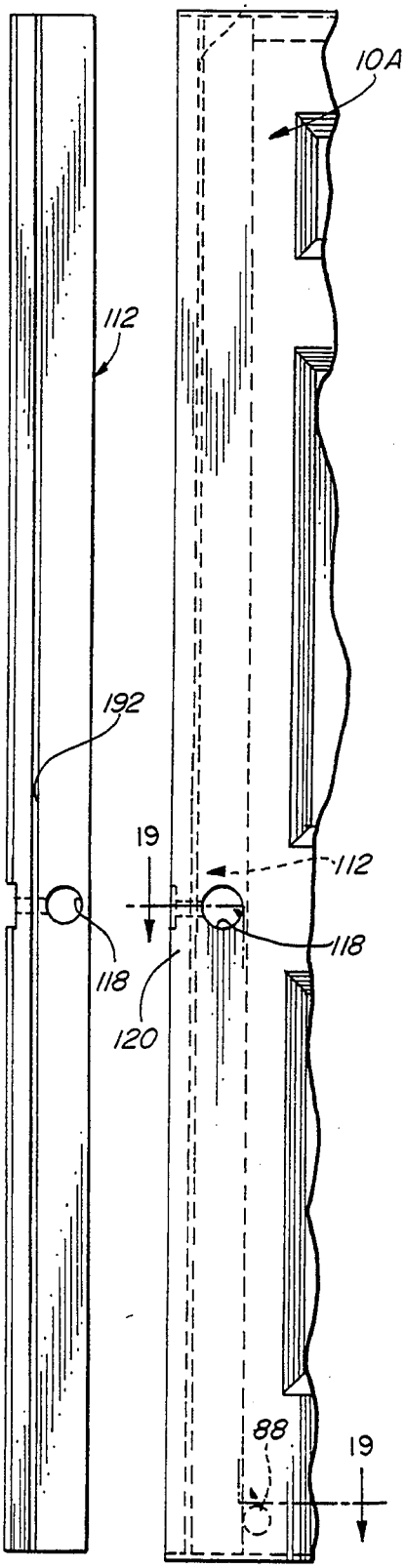
FIG. 17 is a fragmentary front elevational view of another door embodying the present invention and using a wider latch stile.
FIG. 18 is a side elevational view of the latch stile of the door of FIG. 17.
Figure 19:
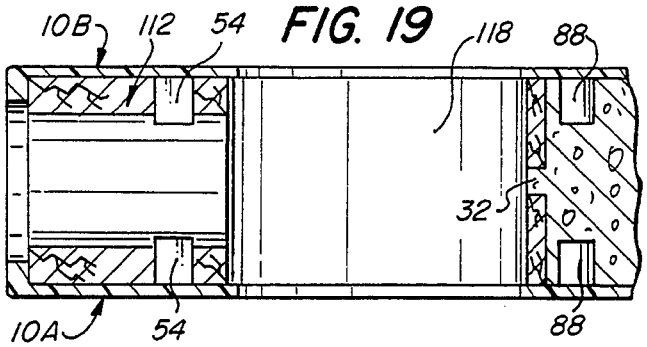
FIG. 19 is a fragmentary cross sectional view of the door of FIG. 17 along the line 19-19 of FIG. 17.
Figure 20:
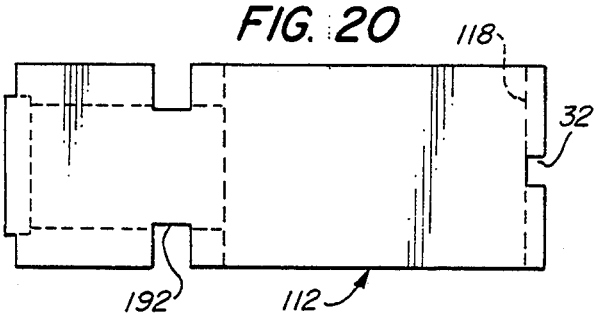
FIG. 20 is a top plan view of the latch stile of FIG. 17.
Figure 21:
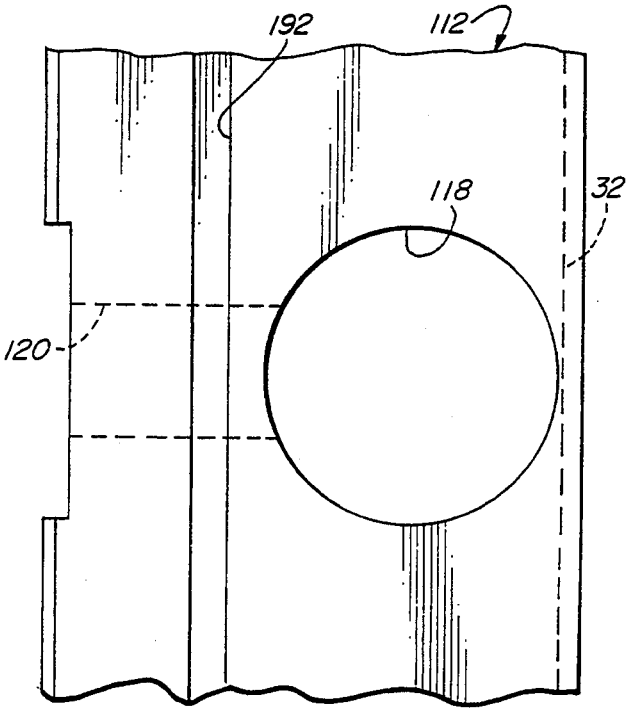
FIG. 21 is an enlarged side elevational view of the latch stile of FIG. 17.
Figure 23:
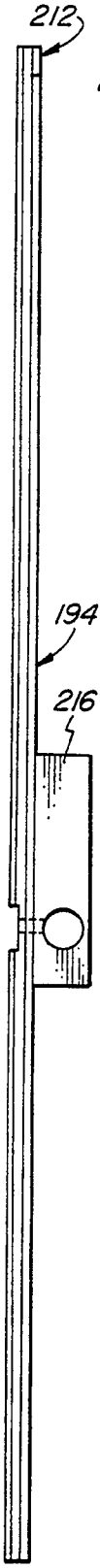
FIG. 23 is a side elevational view of the latch stile assembly of the door of FIG. 22.
Figure 22:
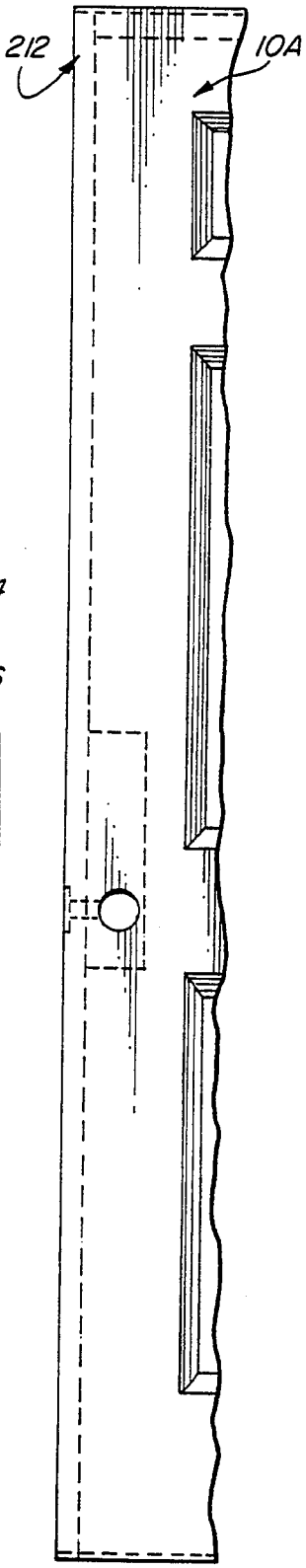
FIG. 22 is a fragmentary front elevational view of another door embodying the present invention and utilizing a metallic reinforcement for the latch stile.
Figure 24:
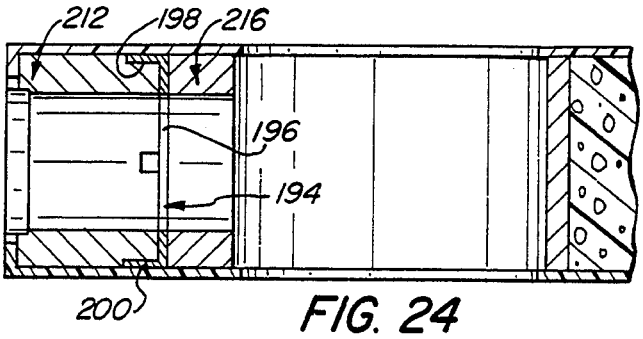
FIG. 24 is a fragmentary cross sectional view of the door of FIG. 22 adjacent the latch stile.
Figure 25:
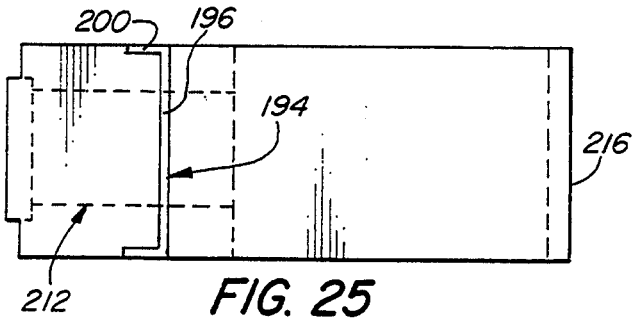
FIG. 25 is a top plan view of the latch stile of FIG. 22.

Turning next to FIGS. 14–16, baffles generally designated by the numeral 78 are provided by the flanges 42, 44 at the bottom of the skins 10A, 10B so as to provide a tortuous path from the interior space to the vent openings 76 therein which are spaced adjacent to the stiles 12, 14. As can be seen in this perspective view, each flange 42, 44 has an arm portion 78, 80 projecting above its body. One projecting arm portion 78 is dimensioned to extend over the interface provided by the overlapping portions 82, 84 which provide a lap joint over much of the length of the flanges 42, 44 to effect the seal therebetween. The other arm portion 80 is dimensioned so as to terminate inwardly from the abutting edges, and to abut with the arm portion 78 over a solid portion of its flange 42. As can be seen, the arm 78 extends over the exit port 76 and air being expelled from the interior space travels through the air passage 86 between the overlapping portions 82, 84 and under the larger arm portion 78 to the exit port or vent opening 76.

Also seen in FIG. 16, the skins 10A, 10B are provided with a generally circular boss 88 adjacent the lower flanges 42, 44 and spaced outwardly from their side edges for a purpose to be described hereinafter. Prior to assembly, the side faces of the stiles 12, 14 are coated with adhesive as are the inside surfaces of the skins 10A, 10B about their perimeter, and this adhesive coating is indicated by the stipple lines 90.

Turning next to FIGS. 17–21, the structure therein is essentially similar to that in the embodiment of FIGS. 1–16 except that the latch stile 112 is of greater width than that in the prior embodiment. As a result, no lock block 16 is required as was the case in the prior embodiment and the opening 118 for mounting the lock set is formed directly in the latch stile 112. The lock passage 120 extends through the stile 112 to the opening 118.

To enable use of the same molded skins with this wider stile, grooves 192 are milled into each side surface of the stile 112 and these seat the bosses 50, 54 and the vertical elements 52. A positioning stop for this wider stile 112 is provided by the circular boss 88 on the surface of the skins 10 at a point spaced inwardly from the boss 50 as is seen in FIG. 16, and it provides the abutment shoulder to position the bottom of the stile 112. As can be seen, the stile 112 has the vent groove or passage 32 formed in its inside face. The rail 8 in this embodiment is shortened by the added width.

Turning now to FIGS. 22–27, another embodiment of the door of the present invention is shown therein, and the latch stile 212 includes a metallic channel member generally designated by the numeral 194 of U-shaped cross section to rigidify the wooden stile 212. The width of the wooden stile 212 is reduced by the thickness of the web 196 of the channel member 194 so that the overall width of the stile assembly is the same and positioning may be effected by the bosses 50, 54. As can be seen, the stile 212 has recesses 198 in its two side surfaces which permit it to seat snugly within the legs 200 of the channel member 194. In this instance, the lock block 216 is secured to the metal reinforced stile by fasteners 202 which extend therethrough.

Turning lastly to the embodiment of FIGS. 27–31, the stile 312 is now reinforced by an I-shaped extrusion generally designated by the numeral 204. In this instance, both the latch stile 312 and the lock block 316 are milled to provide grooves 206 therein so that they will interfit with the flanges 208 of the extrusion 204. As in the prior embodiment, the width of the stile 312 is reduced by the overall width of the extrusion 204 so that the positioning bosses 50, 54 provide abutments for the inner ends of the flanges 208 of the extrusion 204. The lock block 316 in this embodiment may be similarly secured in position by threaded fasteners (not shown) extending therethrough and through the extrusion 204.

Figure 26:
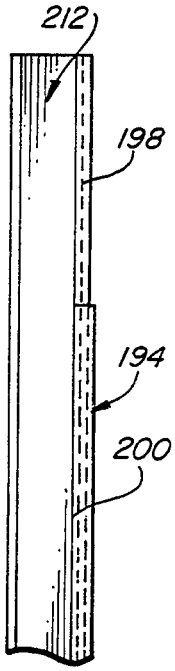
FIGS. 26 and 26A are fragmentary side elevational views of the latch stile and latch stile/lock block assembly of FIG. 22 drawn to an enlarged scale.
Figure 26A:
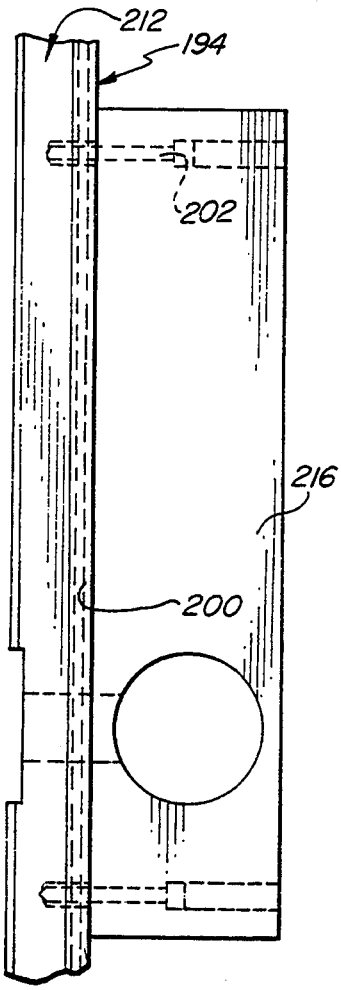
Figure 28:
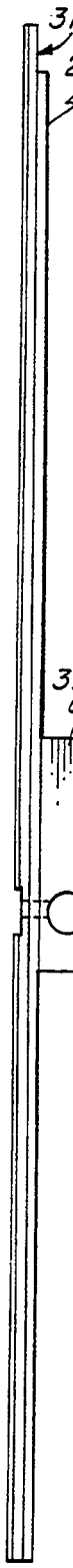
FIG. 28 is a side elevational view of the latch stile of the door of FIG. 27.
Figure 27:
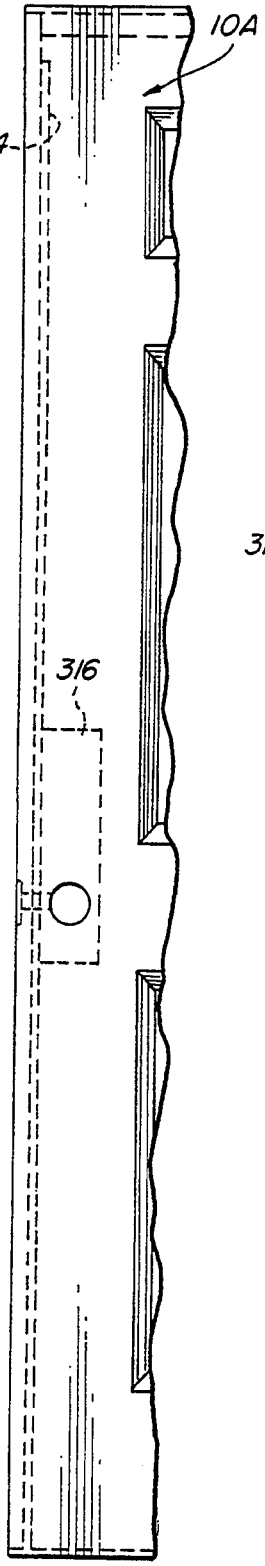
FIG. 27 is a fragmentary front elevational view of another door embodying the present invention which also uses a metallic reinforcement for the latch stile.
Figure 29:
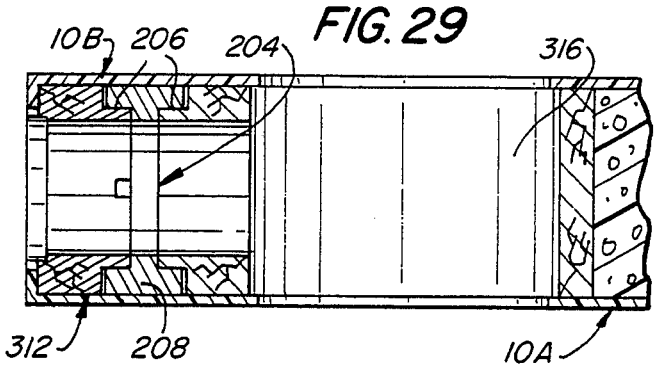
FIG. 29 is a fragmentary cross sectional view of the door of FIG. 27 adjacent the latch stile.
Figure 30:
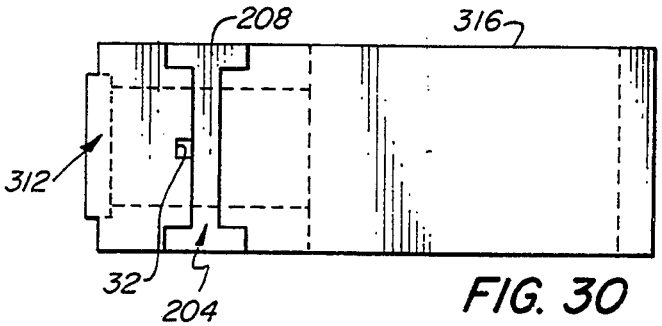
FIG. 30 is a top plan view of the latch stile/lock block assembly of FIG. 27.
Figure 31:
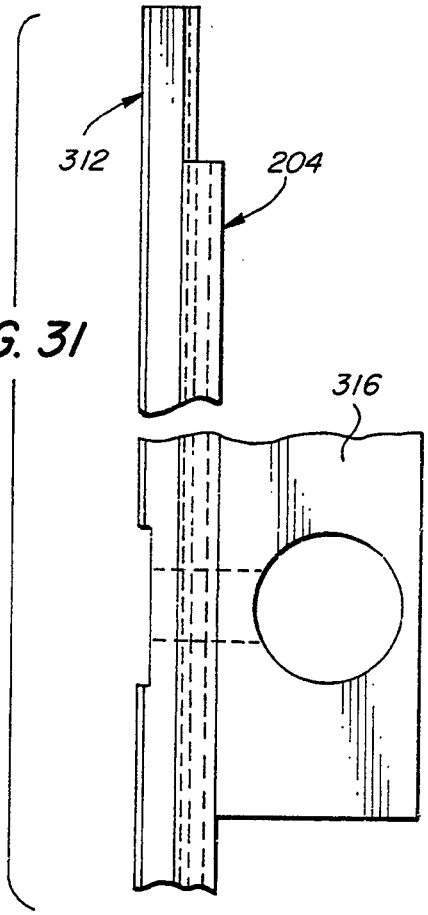
FIG. 31 is an enlarged side elevational view of the latch stile/lock block assembly of FIG. 27.

As noted in FIGS. 26 and 31, the metallic reinforcing elements 194 and 204 need not extend over the full length of the stiles 212, 312 to provide the desired stiffening action. Moreover, it is necessary to drill the latch bolt passage 20 through the stiffening member.

As previously indicated, the design illustrated in the appended drawings permits the same skins to be used for both faces of the door. To achieve this result, the flanges have one configuration for half the width of the skin and a cooperating configuration for the other half of the skin. Thus, when the skin is reversed, the two formations which oppose each other interfit. This enables the use of single mold for each door size and reduces the total cost investment for the molds required for a line of doors. It also minimizes the need for an inventory of a large number of skins and for selecting different skins for the two surfaces of the door.

In assembling the doors of the present invention, the inside perimeter area of a first skin is sprayed with adhesive. The stiles and rails are also sprayed on their side surfaces with adhesive and placed upon the first skin in the appropriate position with their upper ends of the stiles abutting the rail and their lower ends abutting against the stops. When a separate lock block is used, it is assembled to the stile before placement on the skin. The second skin is also sprayed with adhesive and then placed upon the stiles and rails with its flanges abutting and interfitting with the flanges of the first skin.

This assembly is placed within a press providing platens which bear upon the skins so as to prevent them from bowing outwardly under the internal pressure of the foaming operation which is to follow. The press is heated so as to avoid cooling of the skins and to prevent premature cooling of the injected resin formulation.

A mixture of resin and foaming agent is then introduced under pressure through an inlet hole in the bottom flanges and it polymerizes and foams within the interior space defined by the flanges, stiles and rail and produces a cellular foam structure filling the entire cavity. As the resin mixture is introduced and begins to polymerize and expand, air is expelled outwardly through the baffled passages provided by the channels in the rails and the baffles in the lower flanges. After the foam injection and polymerization has been completed, the press is opened and the door is removed.

In subsequent operations, holes for lock sets, dead bolts and the like may be drilled or bored through the skins and stiles, and lock block. Cutouts can be made to substitute lites for the panel formations, and various other secondary operations can be performed. Mortised areas on the stiles can be formed before or after the door is assembled generally, it is preferable to perform such secondary operations before the door has been fully assembled.

Bottom sweeps and weather seals are generally assembled at the time of installation of the door. Although the door can be finished prior to shipment to the dealers, generally it is desirable to provide the door in unfinished state so that no inventory of different types of finishes is required at the dealer's facility.

Because the door is desired to simulate a wooden door, the molds for generating the skins desirably have a surface pattern simulating a wood grain, and the skins are generated with this wood grain pattern at the time of their formation.

Although various techniques can be utilized for generating the skins, compression molding of fiberglass reinforced polyester resins is preferred because of the relatively low cost and resultant durable skin. This composition may also be stained as well as painted. However, other thermosetting resins may be employed for molding the skins and other techniques may be employed if so desired. Moreover, laminates of various resins may be utilized in producing the door skins to obtain the benefits of a high strength, lower cost base layer and a more expensive surface layer of desirable properties for the surface. Moreover, the skins can be made from formulations containing pigments and the like to provide prefinished surface characteristics.

As will be appreciated, the assembled door has substantial structural strength and resists the tendency to warp and the torquing forces which occur during opening and slamming of the door. Although wood stiles do have a tendency to warp with variation in the humidity of the atmosphere to which they are exposed, the door frame and the lips on the skins will resist their outward bowing or warping, and the stops which are positioned along the length of the stiles will resist inward bowing or warping. The top rail enables the door to accommodate the high stress which occurs when it is slammed shut and the torque which occurs when the door is moved by an automatic closer. The interfitting flanges along the top and bottom of the door skins not only provide a seal but also intermit to provide a relatively high strength structural element. The lips on the skins extending along the stiles also serve to provide a finished appearance while permitting secondary operations (e.g., mortising, etc.) of the stiles which they only partially cover.

The doors currently being made by Applicants' assignee pursuant to the present invention are produced as follows.

The skins are formed with a thickness of 0.075 inch and with a textured wood pattern on the surface thereof. The skins are formed from a mixture containing 20% by weight glass fibers, 53% by weight of calcium carbonate filler and 27% of polyester resin. This resin mixture has a viscosity of 10,000,000 centipoises and is compression molded to produce the skins.

The present commercial assemblies use wooden stiles of 1.560 inches in thickness and the width is 4.006 inches for the latch stile and 1.212 inches for the hinge stile. The rail is also 1.560 inches in thickness and is 1.219 inches in width.

The adhesive used for coating the rails and the skins is a polychloroprene adhesive sold by American Helmitin Corporation under the designation HELMIPRENE 4010, and it is applied by spraying.

The platen press between which the assembled skins, stiles and rails is placed is maintained at a temperature of about 115°-120° F. and the platens are held at a pressure of 90 pounds per square inch to resist bowing of the skins.

The resin formulation is a 50:50 mixture of polymethylene polyphenylene polyisocyanate sold by BASF under the designation "ELASTOPOR P1036U Isocyanate" and urethane resin sold by BASF under the designation "ELASTOPOR P1036U Resin" introduced at a rate of 260 grams per second each. The shot time for a door of 2 feet 8 inches width is 3.0 seconds, and for a door of 3.0 feet width is 3.5 seconds. The density of the foam is within the range of 2.0 to 2.2 pounds per cubic foot.

As will be appreciated, the appearance of the door may vary from that which is illustrated and the dimensions can vary depending upon the sizes of the molds which are employed. Although wooden stiles are preferred, composite stiles utilizing metallic reinforcing members may be utilized to produce increased strength. In fact, metallic stiles may be substituted for the wooden stiles which are illustrated although this will complicate the manufacturing and secondary operations to some degree.

Thus, it can be seen from the foregoing detailed specification and attached drawings that the doors of the present invention employ synthetic resin skins which may be molded readily and which may be assembled into doors easily and economically. The door construction is one which has a great deal of strength to resist warping and the bending forces which occur during normal usage. The door is attractive and exhibits long life and it may be easily installed in a door frame.

Having thus described the invention, what is claimed is:

1. In the method of making a door with synthetic resin skins providing the faces thereof, the steps comprising:

(a) molding synthetic resin to form skins for the faces of a door, said skins having flanges along the top and bottom edges thereof which are configured to abut with the flanges of another skin to form peripheral walls extending along the top and bottom edges of the door, said skins also having lips along the side edges thereof of lesser width than said flanges, said flanges being formed with recesses therein to provide vent openings extending through the peripheral walls when assembled;

(b) adhesively bonding to the inside surface of one of said skins a pair of spaced stiles at the side edges of said skins and a top rail extending between said stiles adjacent the top edge of said skin;

(c) placing a second skin on, and adhesively bonding it to, said stiles and rail, such that corresponding top and bottom flanges of said skins abut to provide sealed peripheral walls along the top and bottom edges of said skins, and said stiles seal the space between the side edges of the skins to thereby form an interior space defined by said stiles, rail and flanges with said lips extending along respective portions of the stiles, said stiles, rail and flanges together forming baffled passage means providing restricted passages communicating between said vent openings of said peripheral walls and said interior space;

(d) supporting the assembly of skins, stiles and rail in a heated press; and (e) introducing a foamable synthetic resin mixture under pressure into the interior space between said stiles, rail and flanges, said resin mixture forcing air from the interior space to exit through said passages and vent openings, said mixture expanding and forming a cellular synthetic resin core filling said interior space, and bonding to said skins, stiles and rail while said press prevents said skins from being bowed outwardly under the pressure of the expanding synthetic resin mixture.

2. The method of making a door in accordance with claim 1 wherein said foamable synthetic resin mixture forms a cellular polyurethane.

3. The method of making a door in accordance with claim 1 wherein said synthetic resin used to form said skins is a fiber reinforced polyester.

4. The method of making a door in accordance with claim 1 wherein said flanges have opposing portions configured to interfit.

5. The method of making a door in accordance with claim 1 further including the step of securing a latch block to one of said stiles to provide a reinforced area for seating a lock set.

6. The method of making a door in accordance with claim 1 wherein said skins are formed with horizontally extending stops adjacent the bottom flanges thereof providing abutments against which the lower portions of said stiles abut to effect positioning thereof.

7. The method of making a door in accordance with claim 6 wherein said skins are formed with additional horizontally extending stops spaced upwardly from and in alignment with those adjacent the bottom flange to limit bowing of said stiles.

8. The method of making a door in accordance with claim 1 wherein said baffled passage means includes baffle elements formed on said bottom flanges about the vent openings therein which provide a restricted passage communicating between said vent openings and interior space.

9. The method of making a door in accordance with claim 1 wherein said baffled passage means includes aligned channels in said stiles and rail extending along the inside surface of said stiles and the upper surface of said rail and communicating between said interior space and said vent openings in said top peripheral wall.

10. The method of making a door in accordance with claim 1 wherein the side faces of said stiles and rails and the inside faces of said skins are coated with an adhesive prior to their assembly,

* * * * *